United States Patent [19]

Berry et al.

[11] Patent Number: 4,534,185

[45] Date of Patent: Aug. 13, 1985

[54] EAR FRAME

[76] Inventors: James B. Berry; George Spector, both c/o George Spector, 3615 Woolworth Bldg., 233 Broadway, New York, N.Y. 10007

[21] Appl. No.: 503,282

[22] Filed: Jun. 10, 1983

[51] Int. Cl.[3] ..... A44C 7/00; A44C 15/00

[52] U.S. Cl. ..... 63/1 R; 40/152; 40/159; 63/13; 63/19; 63/29 R

[58] Field of Search ..... 63/12, 29 R, 13, 19, 63/20, 23, 1; 40/152, 154, 159, 10 D, 1.6

[56] References Cited

U.S. PATENT DOCUMENTS

| | | | |
|---|---|---|---|
| 22,390 | 12/1858 | Wade et al. | 63/18 X |
| 270,296 | 1/1883 | Foster | 63/19 |
| 384,346 | 6/1888 | Chappatte | 63/18 X |
| 497,611 | 5/1893 | Stauffer | 63/23 X |
| 1,137,088 | 4/1915 | Rosten et al. | 40/152 |
| 2,519,518 | 8/1950 | Victor | 63/29 R |
| 3,533,247 | 10/1970 | Douglas | 63/13 X |

FOREIGN PATENT DOCUMENTS

| | | | |
|---|---|---|---|
| 2263517 | 7/1974 | Fed. Rep. of Germany | 40/10 D |
| 925652 | 3/1947 | France | 63/29 R |

*Primary Examiner*—F. Barry Shay

[57] ABSTRACT

An earring having an interchangeable message card on one side of a pad suspended from a chain led by a clip from a wearer's ear.

1 Claim, 4 Drawing Figures

EAR FRAME

This invention relates generally to earring such as are by persons for ornamental purposes.

It is well known that to date earrings have been used mainly as an ornamentation without any intended practical purposes. In these times when communications between individuals has become more sophisticated, there is now a greater attention to all objects that may possibly convey a message between individuals. One such object that has been heretofore neglected is the earring.

A principal object of the present invention is to provide an earring which, in one design thereof, carries a visible printed message that can be readily read by other persons who are nearby. Such message may comprise almost anything, such as, for example, an advertisement for selling a product or service, or it may even be some discreet phrase that will attract other persons to the earring wearer, such as "homemaker, good cook, object: marriage" or the like. Alternately the message may simply be just some popular phrase or a funny expression that is currently used by young people, so as to bring young friends together. It may be a religious phrase for use among members of religious groups. In a similar manner, the message may be made suitable for political rallies, various functions of societies, conventions of business establishments and the like.

Another object is to provide an earring in which the message is selectively interchangeable.

Figure 1:
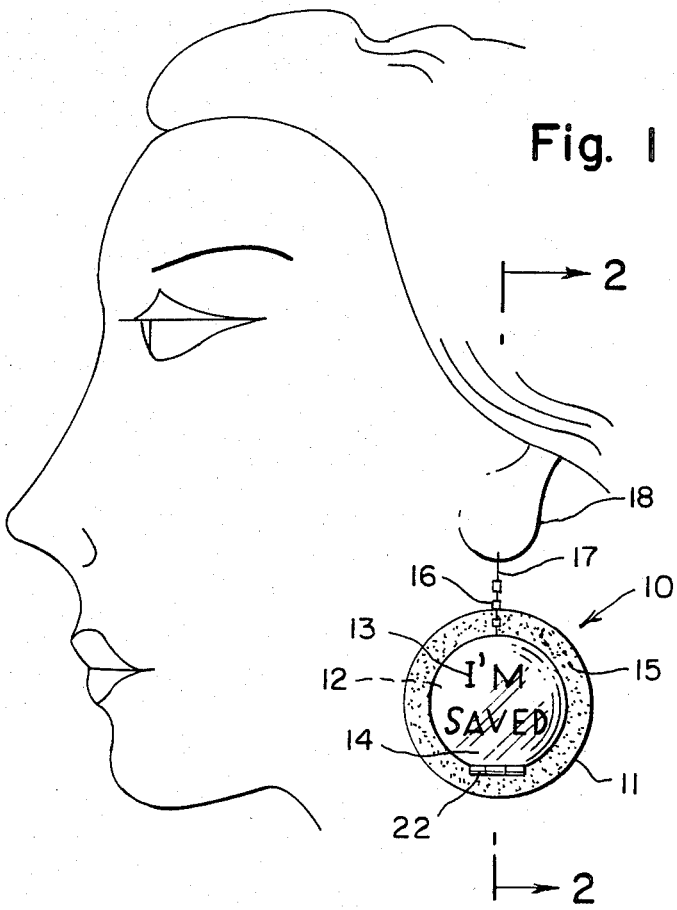
FIG. 1 is a front view of the invention shown being worn on an ear.
Figure 2:
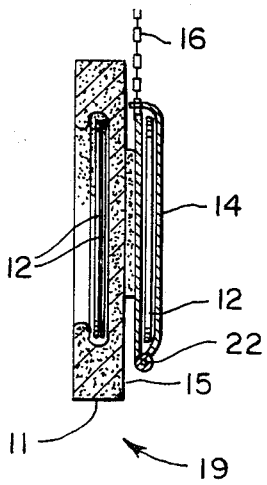
FIG. 2 is an enlarged cross sectional view on line 2—2 of FIG. 1.
Figure 3:
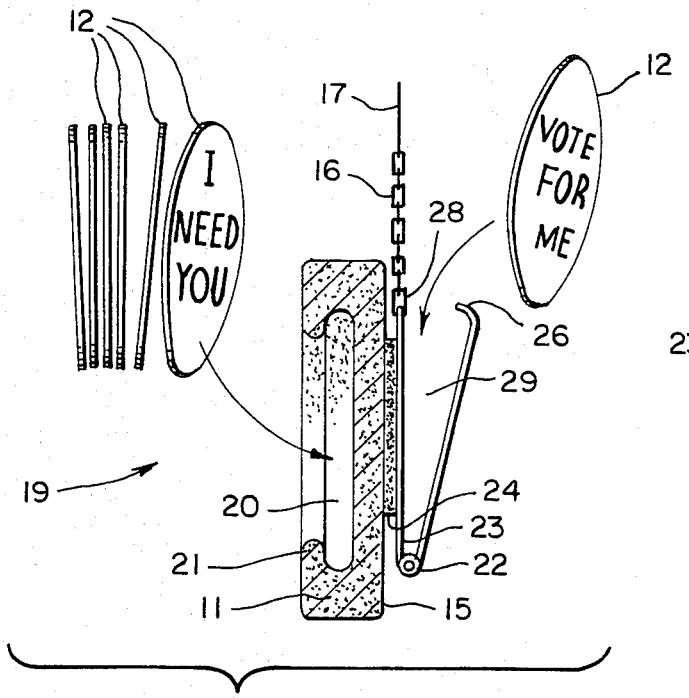
FIG. 3 is a similar view thereof showing the assembly of paper signs behind a transparent window and also storage of extra signs in a pocket behind a rear of the device.
Figure 4:
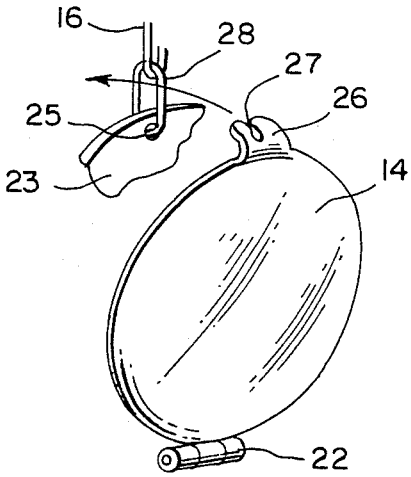
FIG. 4 shows a latching mechanism of the device.

Referring now to the drawing in greater detail, and more particularly to FIG. 1 thereof, at this time, the reference numeral 10 represents an earring according to the present invention wherein there is a pad 11 having a relatively smaller card 12 on one side thereof having a printed message 13 thereupon, the card being covered by a transparent window pane 14 so as to be visible. The pad may be made from a sponge or other suitable material, and being larger than the card or transparent window panel, thus forms an ear frame 15 that is visible theraround. A chain 16 attached thereto, is connected to any form of clip 17 or the like for suspension from a wearer's ear 18.

Instead of a printed text, the message may simply be some artistic design or symbol.

As seen in the drawings the pad is made hollow on its rear side by a cavity 20 in which additional cards 12 may be stored when not displayed behind the window pane, each card carrying a different message so that a wearer can select which one to display.

The cavity is made with an inward flange 21 around its mouth, so as to retain the cards inside the cavity without accidentally dropping out. The sponge pad may be made of resilient material, permitting the flange to be flexed in order to remove or insert the stored cards therewithin.

The window pane is preferably made from a crystal clear, hard plastic which at its lower end is pivotally attached by a hinge 22 to a lower end of a metal backing plate 23 secured by adhesive 24 to the front side of the pad. A hole 25 at an upper end of the backing plate provides connection to the chain 16. A bent over tab 26 formed on the upper edge of the pane, has a slit 27 with narrowed entry for snapping around the lowermost link 28 of the chain so to form a catch that holds the pane from pivoting open, thus locking the displayed card inside a case 29 that is thus formed between the pane and backing plate.

While various changes may be made in the detail construction, it is understood that such changes will be within the spirit and scope of the present invention as is defined by the appended claims.

What is claimed:

1. An ear pendant assembly comprising a plate, a flexible pad secured to the rear of said plate, said pad having means for storing various display cards, a moveable window closure mounted to the front of said plate forming a display cavity for one of said cards, said storing means including a rear opening in said pad smaller than each card providing access to a storage spacer larger than each card, said opening having a flexible flange of material manually distortable for allowing passage of said cards and able to recover its shape to retain said cards in said space, said assembly being in further combination with a chain adapted to be secured to a person's ear.

* * * * *